United States Patent [19]

Smith

[11] Patent Number: 4,561,704

[45] Date of Patent: Dec. 31, 1985

[54] ATM ENCLOSURE

[75] Inventor: Charles L. Smith, Omaha, Nebr.

[73] Assignee: JBA Company, Omaha, Nebr.

[21] Appl. No.: 584,989

[22] Filed: Mar. 1, 1984

[51] Int. Cl.[4] ..... A47B 85/06

[52] U.S. Cl. ..... 312/222; 312/210; 312/212; 312/251

[58] Field of Search ..... 211/81, 168; 403/165; 248/552, 553, 186, 349, 425; 109/45, 48, 50; 312/222, 204, 216, 251, 286, 209, 252, 211, 212

[56] References Cited

U.S. PATENT DOCUMENTS

| | | | |
|---|---|---|---|
| 584,314 | 6/1897 | Albietz | 312/204 |
| 876,335 | 1/1908 | Couper et al. | 312/216 X |
| 1,028,167 | 6/1912 | Williams | 248/186 |
| 1,269,225 | 6/1918 | Sciannamea | 312/222 |
| 1,943,282 | 1/1934 | Bellavia | 312/222 |
| 2,843,959 | 7/1958 | Flauder | 248/349 |
| 3,072,426 | 1/1963 | Gilbert | 403/165 |
| 3,856,373 | 12/1974 | Tucich | 312/216 |
| 4,400,044 | 8/1983 | Yoshiyuki | 312/204 |

*Primary Examiner*—William E. Lyddane
*Assistant Examiner*—Joseph Falk

[57] ABSTRACT

An ATM enclosure comprising a hollow cabinet having front, back and first and second side walls. The back wall of the cabinet has an access door provided therein to enable the servicing the electronic components therein. The cabinet is supported on a supporting surface such as a floor and is adapted to be pivoted about one of its front corners so that the enclosure may be pivoted whereby the back wall and the access door therein is positioned in a convenient manner for servicing.

8 Claims, 7 Drawing Figures

ATM ENCLOSURE

BACKGROUND OF THE INVENTION

Field of Invention

An automatic teller machine is universally known as an ATM. Many automatic teller machines have been located in drive-up facilities or free-standing walk-up facilities. The popularity of the automatic teller machine has resulted in the machines being located in grocery stores or the like where space is at a premium. Conventional ATM cabinets or enclosures normally have the CRT and money dispenser positioned on the top thereof. If a depository is to be located in conjunction with the ATM, the depository is normally positioned on a separate cabinet which results in considerable space being utilized.

A problem also associated with the location of the automatic teller machine in grocery stores or the like is that it must be secured to the floor to prevent the machine from being wheeled out of the store by burglars. The requirement that the automatic teller machine be secured to the floor of the establishment makes it difficult to service the components of the ATM which are located within the cabinet or enclosure.

SUMMARY OF THE INVENTION

The ATM enclosure of this invention comprises a hollow cabinet adapted to support a CPT and a money changer on the upper end thereof and a money depository in the interior as well as the electronic components for the ATM. A pivot is secured to the floor and to one of the lower front corners of the enclosure to permit the enclosure to be pivoted therearound from an operative position to a servicing position. Rollers or wheels are provided at the other three corners of the cabinet to permit the cabinet to be easily pivoted between its operative and servicing positions. A locking assembly is secured to the interior of the cabinet adjacent the other front corner to permit the selective locking of the cabinet in its operative position. Access to the locking assembly is gained through a locked removable panel mounted the front wall of the cabinet. When the cabinet is in its locked operative position, the cabinet cannot be removed from the location. When it is desired to service the components within the cabinet, the removable front panel is removed and the locking assembly unlocked. The cabinet is then pivotally moved about the pivot so that the access doors at the rear of the cabinet are positioned in a convenient position.

Therefore, it is a principal object of the invention to provide an ATM enclosure wherein all of the normal ATM components as well as a depository are included or mounted on a single enclosure.

A further object of the invention is to provide an ATM enclosure which may be pivotally moved about one of its front corners in such a manner so that access may be deemed to the back service door of the enclosure.

A further object of the invention is to provide an ATM enclosure including a locking means which locks the enclosure in a non-pivoting position.

Still another object of the invention is to provide an ATM enclosure which occupies a minimum amount of floor space.

Still another object of the invention is to provide an ATM enclosure which is economical of manufacture, durable in use and refined in appearance.

DESCRIPTION OF THE PREFERRED EMBODIMENT

Figure 1:
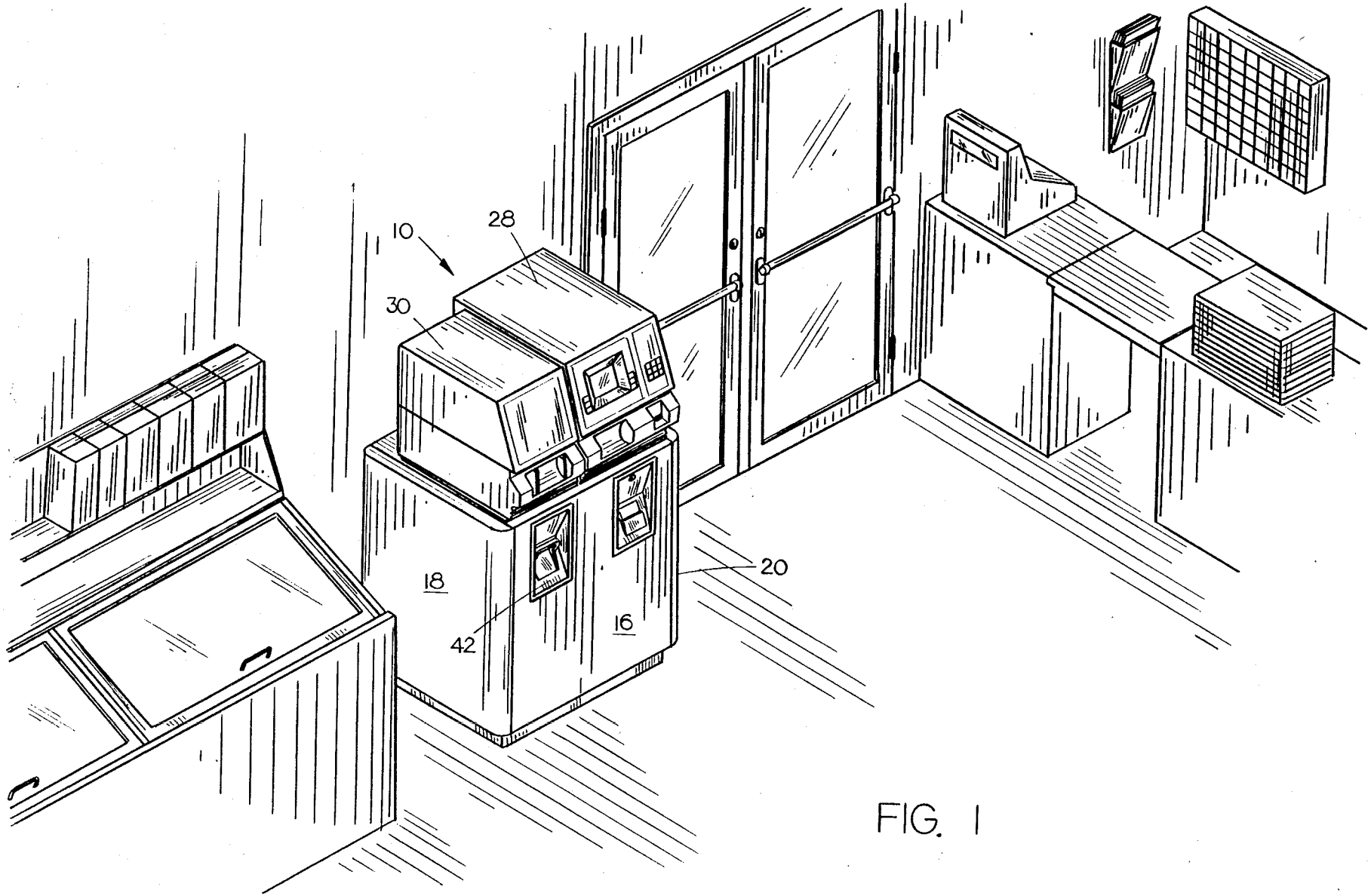
FIG. 1 is a perspective view illustrating the ATM enclosure of this invention installed in a retail store.
Figure 2:
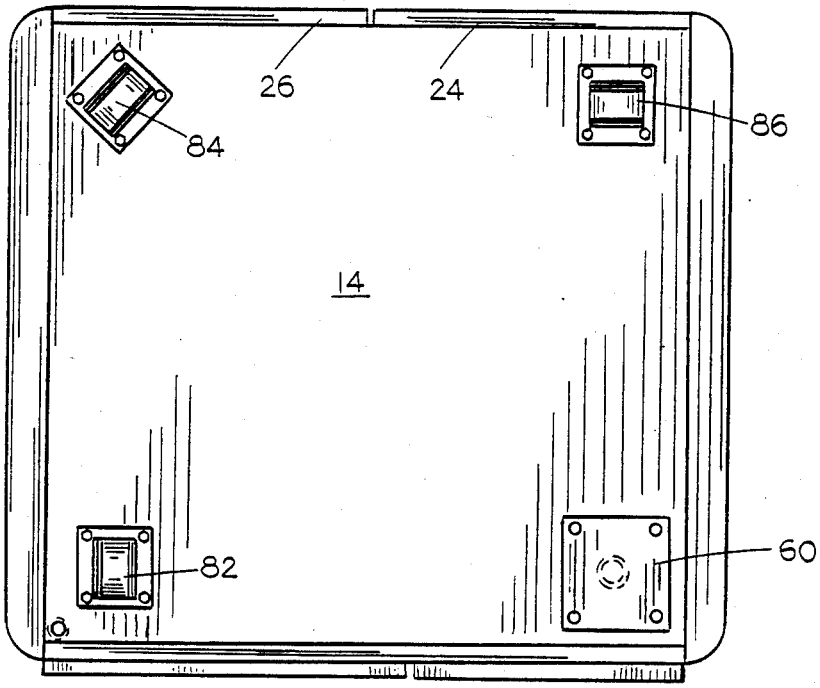
FIG. 2 is a bottom view of the enclosure of this invention.
Figure 3:
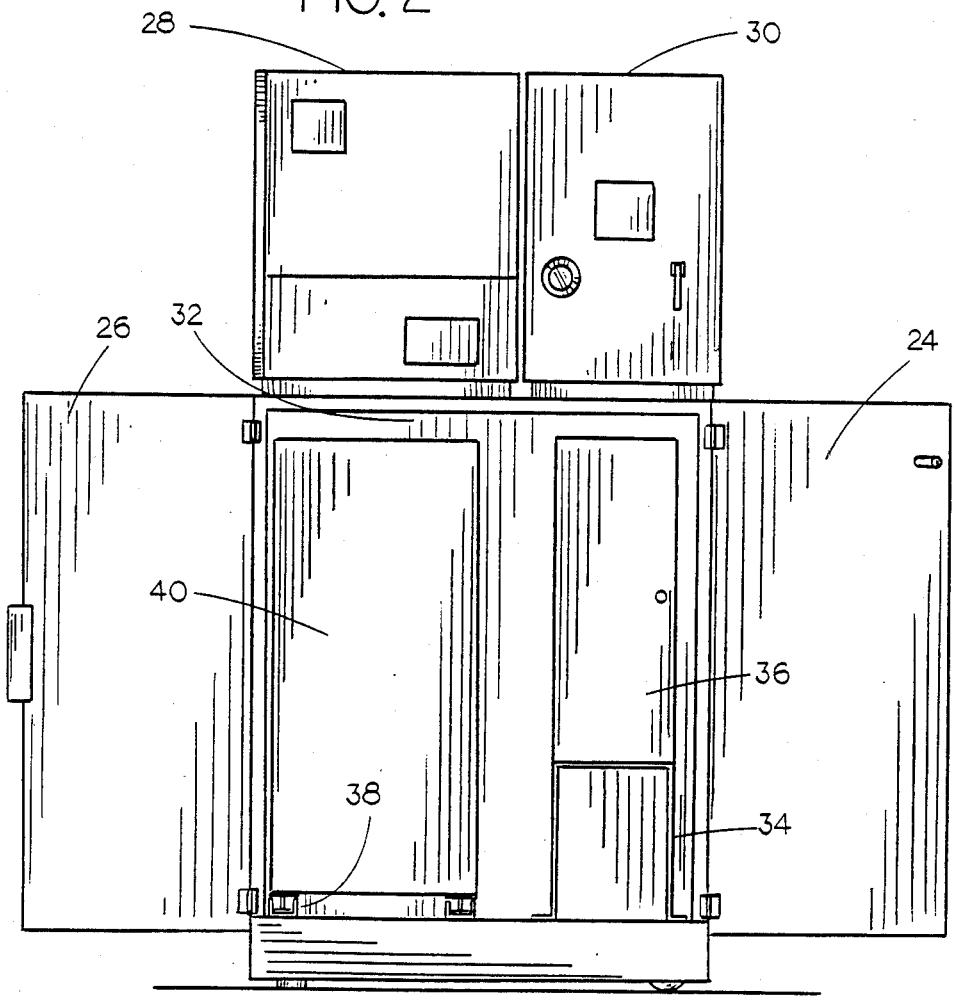
FIG. 3 is a back view of the enclosure of this invention illustrating the access or service doors in an open position.
Figure 4:
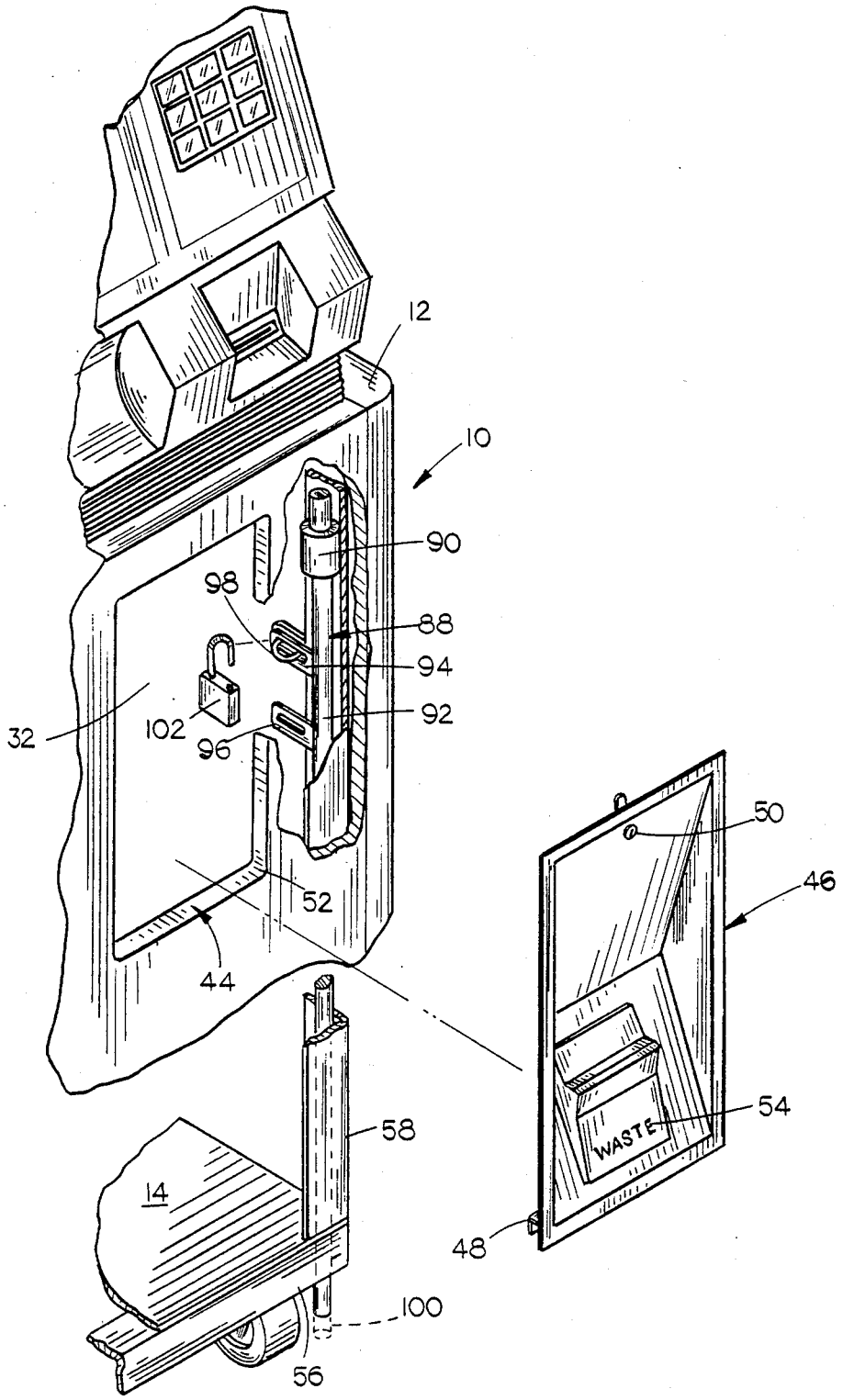
FIG. 4 is a partial perspective view of the enclosure illustrating the pivot locking means.

The ATM enclosure of this invention is referred to generally by the reference numeral 10 and includes a top 12, bottom 14, front wall 16, side walls 18 and 20 and a back wall 22. A pair of service or access doors 24 and 26 are mounted in back wall 22 and may be moved between the open and closed positions illustrated in the drawings.

Top 12 is adapted to have a CRT 28 and money dispenser 30 mounted thereon and secured thereto. The interior 32 of the cabinet is provided with a support 34 upon which is positioned a depository 36. In conventional ATM enclosures, the depository is positioned on a separate cabinet or support but in this invention, the depository is contained within the enclosure. A slide track 38 is provided in the interior 32 of the cabinet or enclosure and is adapted to have the electronic circuitry housing 40 mounted thereon. Normally the housing 40 is positioned within the enclosure but may be slidably moved outwardly on the slide track 38 for servicing as needed.

Figure 7:
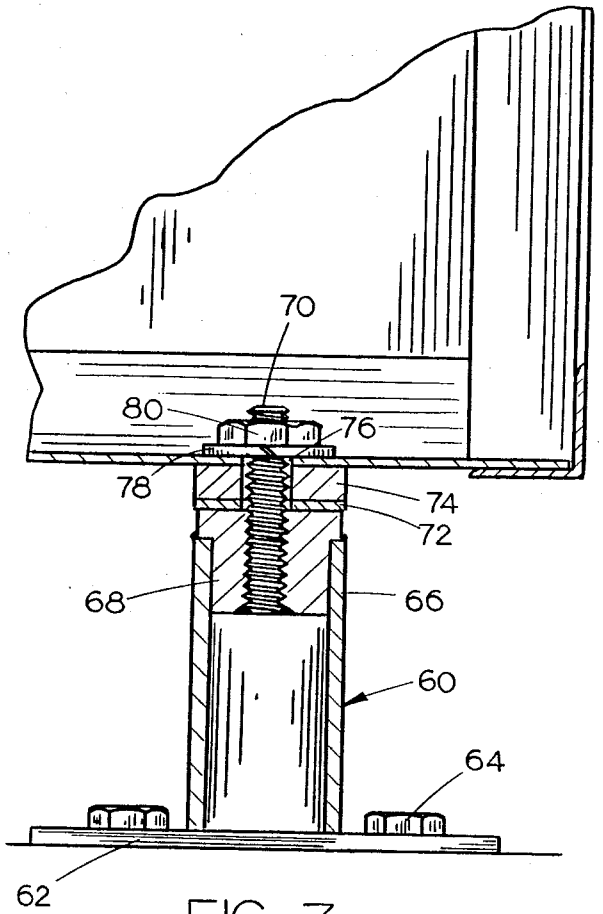
FIG. 7 is a sectional view illustrating the pivot of FIG. 6.
Figure 6:
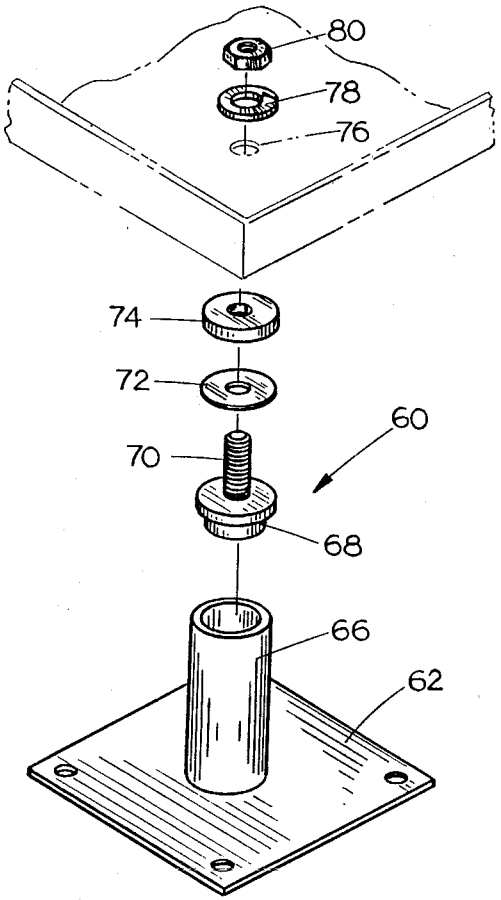
FIG. 6 is an exploded perspective view of the pivot for the enclosure.

Front wall 16 is provided with a panel 42 which communicates with the depository 36 so that customers may make deposits to their account. Front wall 16 is also provided with an opening 44 into which is mounted a panel 46 maintained in the opening by means of flange 48 and locking assembly 50. The flange 48 receives the wall portion 52 and the locking assembly 50 maintains the panel 46 in position as required. As seen in the drawings, the panel 46 also includes a wastepaper receptacle referred to generally by the reference numeral 54. Bottom 14 includes an angle frame 56 which extends around the perimeter of the bottom and which has the bottom 14 mounted thereon. Upstanding angle frames 58 are provided at each of the corners of the enclosure. FIGS. 6 and 7 illustrate the pivot assembly 60 which permits the enclosure to be pivoted between its operative and servicing positions. Pivot assembly 60 includes a plate 62 which is secured to the floor by bolts 64. Tube 66 is secured to plate 62 and extends upwardly therefrom. Head portion 68 of bolt 70 is welded to the tube 66 as illustrated in FIG. 7 and has washer 72 and thrust bearing 74 mounted thereon. Bolt 70 is received by opening 76 in bottom 14 and is maintained therein by means of washer 78 and nut 80. The structure illustrated in FIGS. 6 and 7 permits the enclosure 10 to pivotally move with respect to the plate 62 to enable the enclosure to be pivotally moved between its operative and servicing positions. Wheels 82, 84 and 86 are secured to the bottom 14 at the other three corners thereof and are disposed at the angle of pivotal movement as illustrated in the drawings.

The numeral 88 refers to a pivot locking assembly designed to lock the enclosure in its operative position as desired. Assembly 88 includes a plurality of vertically spaced collars 90 which are welded to the angle frame 58 and which vertically and rotatably receives rod or shaft 92. Shaft 92 has a pair of vertically spaced hasps 94 and 96 mounted thereon which are adapted to be received by the staple member 98. The lower end of rod 92 is adapted to be received in the opening 100 formed in the floor. In its locked position, the assembly 88 would be positioned so that the lower end of the rod 92 is received within the opening 100 and so that the hasp 94 is received by the member 98 and maintained thereon by the lock 102. The panel 46 normally closes the opening 44 which prevents access to the pivot locking assembly. When it is desired to pivotally move the enclosure to its servicing position, the panel 46 is removed from the opening 44 and the operator reaches through the opening 44 to unlock the lock 102 and remove the same. Rod 92 is then pivotally moved to disengage the hasp 94 from the member 98. The rod 92 is then slidably moved upwardly so that the lower end disengages from the opening 100. The rod 92 is then rotated so that the hasp 96 is received by the member 98 to maintain the rod 92 in its uppermost position. If desired, the lock 102 may be simply slipped onto the member 98 to maintain the rod in its raised condition.

Figure 5:
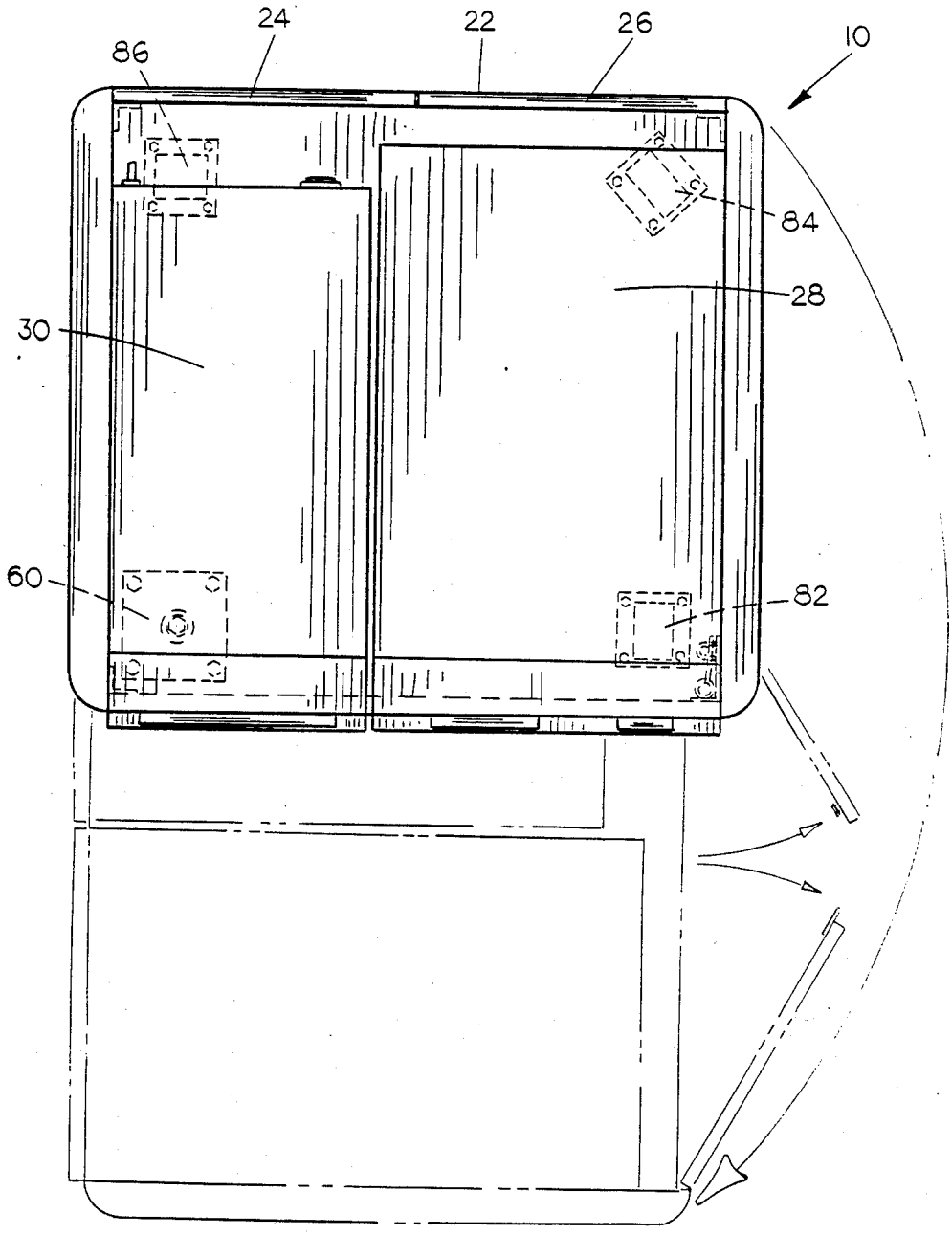
FIG. 5 is a top elevational view of the enclosure with the broken lines indicating the servicing position to which the enclosure may be pivoted.

The cabinet may then be pivotally moved about pivot assembly 60 from the position illustrated by solid lines in FIG. 5 to the position illustrated by broken lines in FIG. 5. It can be seen from FIG. 5 that the pivotal movement of the enclosure is possible in a limited space on either side of the enclosure. The enclosure is easily pivotally moved to the position illustrated by broken lines in FIG. 5 so that the access or service doors 24 and 26 are readily available. The pivot assembly described herein not only permits the convenient pivoting of the enclosure but also provides the proper security to prevent the enclosure from being rolled or wheeled out of the facility.

A very important part of the invention is that an enclosure for an ATM has been provided which permits a depository to be included in a single enclosure rather than providing a separate cabinet or support for the depository. This feature is made possible by the fact that the depository is located within the enclosure and that access to the depository is gained through the front portion of the enclosure.

Thus it can be seen that the enclosure of this invention accomplishes at least all of its stated objectives.

I claim:

1. An ATM enclosure adapted to be positioned on a floor surface comprising, a hollow cabinet means having a front wall, back wall, first and second side walls, a top and a bottom, said back wall having an access opening that is closed by a door, a first supporting wheel secured to said cabinet means at the juncture of said back wall and said first side wall, a second supporting wheel secured to said cabinet means at the juncture of said back wall and said second side wall, a third supporting wheel secured to said cabinet means at the juncture of said first side wall and said front wall, a pivot means secured to the floor surface and to said cabinet means at the juncture of said front wall and second side wall whereby said cabinet means may be pivotally moved about said pivot means, between operative and servicing positions, so that said access opening in said back wall will be more conveniently positioned to permit access to the interior of said cabinet means, said pivot means including a base, means for securing said base to said floor surface, and coacting fastener means on said base and cabinet means such that said cabinet means is pivotally movable about said base upon securement of said base to a floor surface, and means for locking said cabinet means in its operative position.

2. The enclosure of claim 1 wherein said locking means comprises a selectively vertically movable elongated bar means, movable between an upper unlocked position and a lower locked position, secured to said cabinet means in the interior thereof, the lower end of said bar means being lowered below said supporting wheels for receipt within an opening in said floor surface when in its lower locked position.

3. The enclosure of claim 2 wherein a lock means is removably secured to said bar means for locking said bar means in its lower locking position.

4. The enclosure of claim 3 wherein a removable access panel is provided on said front wall which may be selectively removed to provide access to said lock means.

5. The enclosure of claim 4 wherein said access panel comprises an envelope storage means.

6. The enclosure of claim 1 wherein the top of said cabinet means is adapted to receive a CRT and money dispenser.

7. The enclosure of claim 6 wherein said cabinet means is provided with a support frame therein for supporting a currency depository means therein and wherein said front wall has an opening formed therein which communicates with said depository means.

8. The enclosure of claim 2 wherein the coacting fastener means on said cabinet means is situated within said cabinet means such that access to the interior of said cabinet means is required for access to said coacting fastener means.

* * * * *